United States Patent [19]

Buckman et al.

[11] Patent Number: 4,842,487

[45] Date of Patent: Jun. 27, 1989

[54] PUMPING DEVICE USING PRESSURIZED GAS

[76] Inventors: William G. Buckman, 504 Memphis Junction Rd.; Robert L. Boots, 3036 Hunting Creek Dr., both of Bowling Green, Ky. 42101

[21] Appl. No.: 97,258

[22] Filed: Sep. 17, 1987

Related U.S. Application Data

[63] Continuation of Ser. No. 819,683, Jan. 17, 1986, abandoned.

[51] Int. Cl.[4] ..... F04F 1/06; F04F 3/00

[52] U.S. Cl. ..... 417/132; 417/135; 417/136; 417/138

[58] Field of Search ..... 417/118, 132, 135, 136, 417/138, 126, 128, 54, 129

[56] References Cited

U.S. PATENT DOCUMENTS

| | | | |
|---|---|---|---|
| 533,355 | 1/1895 | Hermes | 417/128 |
| 634,622 | 12/1899 | Shaffner | 417/118 |
| 656,572 | 8/1900 | Petermann | 417/128 |
| 964,693 | 7/1910 | Richardson | 417/118 |
| 1,187,579 | 6/1916 | Watts et al. | 417/128 |
| 1,296,364 | 3/1919 | Burton | 417/108 |
| 1,326,321 | 12/1919 | Callahan | 417/118 X |
| 1,487,756 | 3/1924 | Pfau | 417/128 |
| 2,284,166 | 5/1942 | Pye | 417/118 X |
| 2,730,961 | 1/1956 | Yeomans | 417/128 X |
| 3,422,768 | 1/1969 | Repp | 417/147 |
| 3,647,319 | 3/1972 | McLean et al. | 417/143 |
| 3,791,763 | 2/1974 | Faldi | 417/118 |
| 4,321,017 | 3/1982 | Gottliebson | 417/138 X |

FOREIGN PATENT DOCUMENTS

| | | | |
|---|---|---|---|
| 657955 | 3/1938 | Fed. Rep. of Germany | 417/128 |
| 107101 | 6/1917 | United Kingdom | 417/132 |
| 865622 | 4/1961 | United Kingdom | 417/118 |

*Primary Examiner*—Carlton R. Croyle
*Assistant Examiner*—Leonard P. Walnoha
*Attorney, Agent, or Firm*—David M. Carter

[57] ABSTRACT

There is provided an improved fluid pumping device including an enclosure to be placed downhole in a well. A first hollow tube is received in the enclosure and extends to the surface of the well for removing fluid from the well. A second hollow tube also extends into the enclosure for forcing a gas into the enclosure. The bottom of the enclosure has an opening for permitting fluid to enter. A mechanical mechanism is provided for forcing the closing of the opening in the enclosure so that the device may be utilized in deep wells where high fluid pressures occur.

17 Claims, 3 Drawing Sheets

PUMPING DEVICE USING PRESSURIZED GAS

This is a continuation of co-pending application Ser. No. 819,683 filed on Jan. 17, 1986, now abandoned.

BACKGROUND OF THE INVENTION

This invention relates to a pump which is suitable for pumping liquids such as water and oil from boreholes and the like. This pump operates by using relatively low gas pressure to elevate liquids from either shallow depths or relatively large depths.

Several different pumps are available to pump oil and water. The most widely used method for pumping oil is by using a jackpump connected to rods and tubings. Methods using air to propel liquids to the surface are air lift pumps, compressed air centrifugal pumps, and air pumps which require pressures sufficient to overcome the hydrostatic head of the liquid in the hole.

Jackpumps are relatively expensive, bulky, and because of the weight of the unit, a crane or hoist is necessary when the unit is installed and removed when servicing. Usually, these units are powered by electric motors, and the efficiency of lifting oil by this unit in the field is very low, usually less than one percent.

The air lift system is simple in use, but it depends on the relative densities of liquid and/or air-liquid mixture and for deeper wells, the required pressure and volume of air is quite large. Also, the air in this system often emulsifies the oil. A typical air lift system is described in U.S. Pat. No. 759,706. Anthony et al. U.S. Pat. No. 4,092,087 also discusses a very complicated air operated pump, where compressed gas or air in the range of 25–350 PSI is utilized with a large float to cause the pump to force the fluid up a tube. This complicated construction is obviously quite expensive.

Air pumps have been designed such that the liquid passes through a ball valve located on the bottom of the pump tank. U.S. Pat. No. 919,416 to Boulicault and Japanese Pat. No. 56-81299 by Nakayama discuss such a system with an air tube connected to the top of the tank and a liquid discharge tube extending to the bottom of the tank. After the tank fills with liquid flowing through the bottom ball valve, air pressure is applied to the air tube which closes the bottom valve and forces the contents of the liquid up the discharge tube. If the liquid level is several hundred feet or more above the pump, considerable air pressure is necessary to overcome the hydrostatic level of the liquid to close the bottom valve and even greater pressure is required to force the liquid to the surface. McLean et al U.S. Pat. No. 3,647,319 employs a similar method with the addition of a ball valve in the liquid discharge tube to prevent the liquid in the discharge line from returning to the tank of the pump. This unit requires rather large air pressure to elevate liquid from deeper wells. In column 3 of their patent, they state that full discharge will occur from any depth within range of 0 to 300 feet. At a depth of 1,000 feet below the top of the fluid, a pressure of about 460 PSI and a large air volume will be required to discharge water from that borehole.

OBJECTS OF THE INVENTION

It is one object of the present invention to provide a pump which will overcome the various limitations referred to above and will be capable of pumping fluid from either shallow or deeper wells using relatively low gas pressure.

It is another object to provide a pump which is very efficient at depths over 1,000 feet when compared to pumps in use today.

It is still another object to provide a pump having low construction cost and having minimal maintenance upkeep.

SUMMARY OF THE INVENTION

In accordance with one form of this invention, there is provided a fluid pumping device having an enclosure which is adapted to be placed downhole in a well containing fluid. A first hollow tube extends into the enclosure for receiving fluid as it is pumped out of the enclosure and up and out of the well. A second hollow tube extends into the enclosure for forcing a gas therein. The first and second tubes each have an opening therein inside of the enclosure. The enclosure also has an opening for permitting fluid to enter. A mechanism is provided for mechanically forcing the closing of the opening in the enclosure. A mechanism is further provided for closing the opening in the first tube. Thus, a column of fluid may be intermittently forced from the enclosure through the first tube and out of the well. In another form of applicants' invention, a funnel is connected near the opening in the first tube for preventing substantial fluid turbulence around the opening in the first tube. The funnel may include a plurality of holes therein, permitting the fluid to pass through.

DESCRIPTION OF THE PREFERRED EMBODIMENTS

Figure 1:
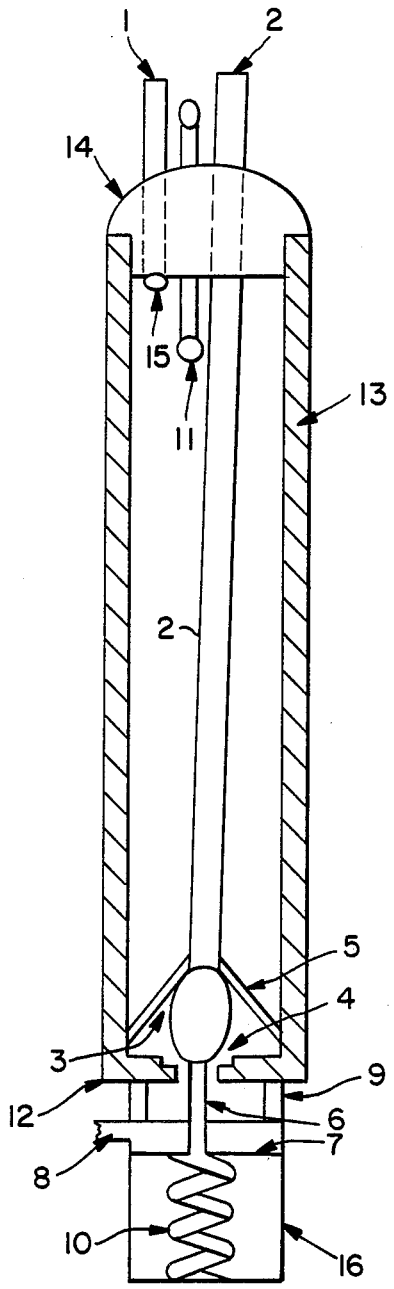
FIG. 1 is a longitudinal sectional view of the pump unit taken on a plane containing the longitudinal axis thereof, showing the two bottom ball valves in normal position.
Figure 2:
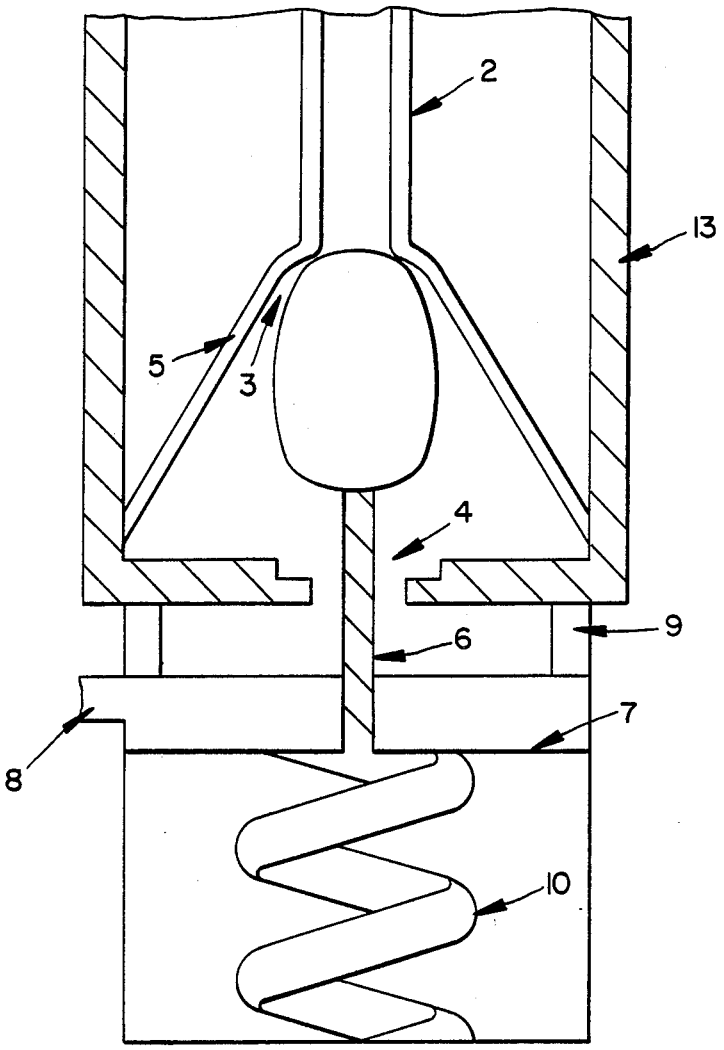
FIG. 2 is an enlarged view of the bottom section of the pump unit illustrated in FIG. 1. This illustrates the bottom two ball valves, the elements of the air cylinder, and an inverted funnel extending from the center discharge tube to the inner wall of the pump tank.
Figure 3:
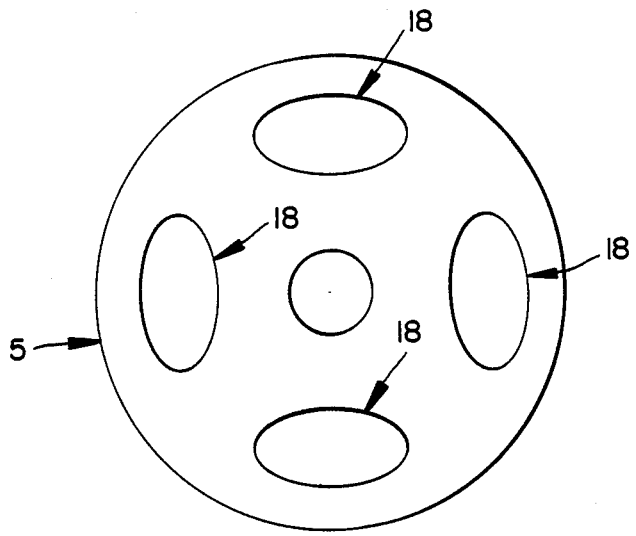
FIG. 3 is a top view of the funnel around the center tube to illustrate the holes through which fluid passes between the upper part of the pump tank and the lower part of the pump.

According to the present invention, it is proposed to provide a pump unit as illustrated in FIG. 1. An air inlet 1 is connected to the top of the pump and connects to an air supply above the borehole and located at the central control box. A liquid discharge tube 2 extends through the top of the pump unit down to near the bottom of the pump tank. The top of the liquid discharge tube goes to a tank usually located at ground elevation. The wall 3 of the pump tank can be made of plastic or metal, but it must withstand the differential pressures without substantial flexing. The ball valve 15 prevents the liquid from entering the air inlet tube 1. The top plate or mold 14 is attached to the top of the cylinder of the tank. The valve 3 at the bottom of the liquid discharge tube 2 is normally closed. Rod 6 is connected to an air operated cylinder consisting of an water inlet 9, rod 6, low friction plunger 7, a spring 10, and a wall 16. The wall 16 of the cylinder must be rather rigid to withstand large presssures without flexing. Valve 4 is the bottom valve; when it is open, it allows liquid to enter the tank from the borehole. It is understood that two valves may be placed in series in place of one valve at the bottom to reduce the chances of malfunction and to keep air from the borehole. An inverted funnel 5 with slots attached controls the path of fluid flow between the top of the pump tank and the lower portion of the pump tank. The semi-ball shaped object used to close valve 3 is mechanically attached to the semi-ball shaped object used to close valve 4. Rod 6 is attached to the semi-ball shaped ends and is attached to the plunger in the air cylinder. This air operated cylinder is attached to the base plate 12 of the pump tank. A small diameter air line (not shown) from the surface is connected to the air inlet 8 of the cylinder and air pressure in this line causes the plunger to move down and the rod 6 pulls the semi-ball object down to open valve 3 and to close valve 4. When air pressure is reduced in the cylinder by venting the air line to atmospheric air to the ground surface, the spring in the cylinder forces rod 6 up to close valve 3 and open valve 4. A liquid sensor 11 is mounted inside the tank near the top of the tank. Another liquid sensor 17 is mounted outside of the tank and above the top of the tank. Electrical leads extend from each of these sensors to the control unit (not shown), which is usually located above ground. The control unit is of a type known to those skilled in the art, and its description is not important in the understanding of this invention.

In order that said invention may be clearly understood, a detailed description will be given for the pump operating at a depth of 1,000 feet from the top of the ground and with 800 feet of oil above the pump. Only for example, consider a pump which has a tubular shaped tank with dimensions of three inches inner diameter and a length of eight feet and a liquid discharge tube with inner diameter of one inch. The fluid in the tank will produce a column of fluid in the one inch discharge tube about 65 feet in length. The head pressure for a column of oil 65 feet deep is about 27 PSI.

The pumping cycle will be as follows:

With the rod 6 of the air cylinder in the up or normal position and the pump submerged in liquid in the borehole, the liquid will flow from the borehole up through the bottom valve of the pump tank and through ports in item 5 to fill the tank. When liquid fills to liquid level sensor 11, an electrical signal causes the control unit above ground to provide pressure through air inlet 8 of the air cylinder. Because the pump is located 800 feet below the top of the oil, the pressure at the bottom of the tank is about 330 PSI. If the bottom valve has a diameter of three-quarters inch, the rod must apply a force of 146 pounds to close valve 4. A three inch plunger 7 in the air cylinder will provide sufficient mechanical advantage such that only about 22 PSI must be applied to the air cylinder to close valve 4.

After valve 4 is closed, compressed air provided by an air tank located at the surface provides air through a second air line to air inlet 1 to open the one way valve 15 and pressurize the top of the tank. This forces liquid through the ports in item 5 and through open valve 3 and up the liquid discharge tube 2. The purpose of the lower open ports in item 5 is to provide for better uniform flow through valve 3 and into the liquid discharge tube 2. If a pressure of 60 PSI or greater is pushing this 65 feet column of oil up the liquid discharge tube 2, this oil shoots up as a column all the way to the top of the borehole. After this column of oil has exited the discharge tube, the controls at the top of the ground vents air tube 1 and liquid discharge 2 to the atmosphere; therefore, tube 1, tube 2, and the pump tank all return to atmospheric pressure. After these are near atmospheric pressure, the valves connecting air line tube 1 and the liqid discharge tube 2 are closed. If liquid sensor 17 indicates fluid is of sufficient height to pump, then a valve is opened to allow the air line connected to air inlet 8 to allow the pressure in the cylinder to be reduced to such an extent that the spring pushes rod 6 up to close valve 3 and open valve 4. The cycle is now ready to be repeated.

Although the pump may be operated by automatic timer controls, liquid sensors 11 and 17 will enable actions to occur at the most appropriate time for greater pumping efficiencies. Sensor 17 also informs one whether the level is sufficient for pumping action. If sensor 17 indicates liquid is above that level and yet no liquid is being pumped, one then knows that the pumping unit is not operating properly.

Pump units of different sizes and shapes may be used with any air pulse supply unit which is available. This pump is relatively easy to assemble and is relatively cheap to make and in the event of its loss down a borehole, or damage, the cost of replacement is small compared to other pumping units. It is also possible to installan air pulse system at one central location above ground and to operaete several pumps from this one air supply and control unit.

It should be understood that the foregoing disclosure relates to only preferred embodiments of the invention and that it is intended to cover all changes and modifications of the invention herein chosen for the purposes of the disclosure which do not constitute departures from the spirit and scope of the invention.

We claim:

1. A fluid pumping device comprising;

an enclosure adapted to be placed downhole in a well containing fluid;

first, second and third openings in said enclosure;

a first hollow tube connected to said first opening in said enclosure; said first hollow tube for receiving fluid as it is pumped out of said enclosure and up and out of the well; a second hollow tube;

portions of said first and second hollow tubes forming a part of said enclosure; said second hollow tube connected to said second opening in said enclosure; said second hollow tube for receiving a gas and for forcing the gas into the remainder of said enclosure;

said third opening for permitting fluid to enter said enclosure;

means for forcing the closing of said third opening in said enclosure;

non-mechanical means for sensing the level of fluid inside of said enclosure for initiating the forcing of gas into said enclosure through said second tube;

means for opening said first opening in response to said means for sensing;

whereby coumns of fluid may be intermittently forced from said enclosure through said first tube and out of the well.

2. A fluid pumping device comprising:

an enclosure adapted to be placed down hole in a well containing fluid;

first, second and third openings in said enclosure;

a first hollow tube connected to said first opening in said enclosure; said first hollow tube for receiving fluid as it is pumped out of said enclosure and up and out of the well;

a second hollow tube connected to said opening in said enclosure; said second hollow tube for forcing a gas into said enclosure;

said third opening for permitting fluid into said enclosure;

means for closing said first opening in said enclosure while said third opening is open;

means for forcing the closing of said third opening in said enclosure while said first opening is open;

non-mechanical means for sensing the level of fluid inside of said enclosure for initiating the closing of said third opening in said enclosure and further for initiating the forcing of gas into said enclosure through said second tube;

means for opening said first opening in response to said means for sensing;

whereby columns of fluid may be intermittently forced from said enclosure through said first tube and out of the well.

3. A device as set forth in claim 1, further including means for sensing the presence of fluid outside of said enclosure.

4. A device as set forth in claim 1, wherein said means for mechanically forcing the closing of said third opening in said closure includes a movable valve assembly.

5. A device as set forth in claim 4, wherein said valve assembly includes a substantially curved object for covering said third opening in said enclosure, said assembly further including a piston contained within a housing, said piston connected to said curved object for moving said object to close said third opening in said enclosure at a first predetermined time and to close the first opening at a second predetermined time.

6. A device as set forth in claim 5, wherein said piston is spring biased, whereby said opening in said enclosure is normally open, said piston adapted to be connected to a source of compressed gas.

7. A device as set forth in claim 1, further including a funnel connected to said first tube near said first opening, said funnel having a plurality of holes therein for preventing substantial fluid turbublence around said first opening.

8. A device as set forth in claim 1, further including means for closing the second opening in said enclosure.

9. A fluid pumping device comprising:

an enclosure adapted to be placed downhole in a well containing fluid;

a first hollow tube extending into said enclosure, said first hollow tube for receiving fluid as it is pumped out of said enclosure and up and out of the well;

a second hollow tube extending into said enclosure, said second hollow tube for forcing gas into said enclosure, said first and second tubes each having at least one opening inside of said enclosure; said enclosure having an opening for permitting fluid to enter said enclosure;

means for sensing the level of fluid in said enclosure;

means for closing said opening in said enclosure;

means for closing said opening in said first tube; means for opening said opening in said first tube in response to said means for sensing; said gas being forced into said enclosure in respnse to said means for sensing; a funnel connected to said first tube near said opening in said first tube for substantially preventing fluid turbulence around said opening in said first tube.

10. A device as set forth in claim 9, wherein said funnel includes a plurality of holes therein.

11. A method of moving oil from a oil well boreehole extending below the surface of the ground using a container within said borehole in contact with the oil; said container having a first valve for permitting oil to enter said container and a second valve connected to a tube for permitting oil to leave the container comprising the steps of:

opening said first valve, thereby permitting fluid to enter said container;

closing said second valve prior to the container being filled with oil, thereby substantially preventing oil from leaving said container, non-mechanically sensing the level of oil in said container, closing said first valve in response to said sensing when a predetermined amount of oil is received in said container; opening said second valve in response to said sensing forcing gas into said container in response to said sensing whereby a substantial amount of said oil is removed through said second valve and through said tube to the surface.

12. A method as set forth in claim 11, wherein when said first valve is closed, said second valve is open, and when said first valve is open, said second valve is closed.

13. A method of moving fluid from a reservoir using a container having a first opening for permitting fluid to enter said container, and a second opening connected to a tube for permitting fluid to leave the container, comprising the steps of:

opening said first, opening thereby permitting fluid to enter the container;

preventing a substantial amount of fluid from entering said tube prior to the fluid leaving said container;

non-mechanically sensing the amount of fluid in said container;

closing said first opening when a predetermined amount of fluid is received in said container;

opening said second opening in response to said sensing;

forcing gas into said container in response to said sensing whereby a substantial amount of fluid is moved through said second opening and through said tube to the location remote from the reservoir.

14. An oil pump received in an oil well borehole containing oil comprising:

a container having first, second, and third openings and first and second tubes, said first opening communicating with the oil in said borehole, said second opening connected to said first tube for discharging oil; a first valve for closing said first opening; a second valve for closing said second opening; non-mechanical means for sensing the level of fluid in said container; said third opening connected to said second tube; said second tube connected to a source of pressurized gas; said second valve being closed when said first valve is open; and said second valve being open in response to said means for sensing said gas being applied to the inside of said container in response to said means for sensing.

15. A container as set forth in claim 14, wherein said first and second valves are connected together.

16. A container as set forth in claim 15, wherein said first and second valves are each semi-balls for respectively covering said first and second openings.

17. A method for intermittently pumping short columns of fluid from a well comprising the steps of:

placing a container in said well; said container having a gas receiving opening and an associated first tube, a fluid receiving opening and a fluid discharge opening a valve for closing said discharge opening, second tube, permitting fluid to enter the container; non-mechanically sensing the level of fluid in said container; applying compressed gas to the inside of the container in response to a predetermined level of fluid which is sensed; opening said valve and forcing a volume of fluid out in the discharge opening in response to said sensing equal to or less than the total volume of the container whereby a column of limited volume is pumped from the well.

* * * * *